US006627129B1

(12) United States Patent
Schwinn et al.

(10) Patent No.: US 6,627,129 B1
(45) Date of Patent: Sep. 30, 2003

(54) PROCESS OF MAKING HIGH RV POLYAMIDE FILAMENTS

(75) Inventors: Glenn Alan Schwinn, Seaford, DE (US); Gary Raymond West, Seaford, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/798,273

(22) Filed: Feb. 20, 2003

Related U.S. Application Data

(62) Division of application No. 09/428,327, filed on Oct. 27, 1999, now Pat. No. 6,235,390.

(60) Provisional application No. 60/106,771, filed on Nov. 3, 1998.

(51) Int. Cl.[7] ..... D01D 5/22; D01D 5/26; D01F 1/02; D01F 6/60; D02G 3/02

(52) U.S. Cl. ..... 264/103; 264/143; 264/168; 264/211; 264/211.22; 264/211.23

(58) Field of Search ..... 264/103, 143, 264/168, 211, 211.22, 211.23

(56) References Cited

U.S. PATENT DOCUMENTS

| | | | |
|---|---|---|---|
| 2,172,374 | A | 9/1939 | Flory |
| 3,015,651 | A | 1/1962 | Kjellmark, Jr. |
| 3,031,433 | A | 4/1962 | Monroe, Jr. |
| 3,254,429 | A | 6/1966 | Livingston |
| 3,390,134 | A | 6/1968 | Kilber |
| 3,480,596 | A | 11/1969 | Simons |
| 3,562,206 | A | 2/1971 | Silverman et al. |
| 3,634,359 | A | 1/1972 | Breitschaft et al. |
| 3,657,388 | A | 4/1972 | Schweizer et al. |
| 3,821,171 | A | 6/1974 | Beaton |
| 4,223,128 | A | 9/1980 | Halek et al. |
| 4,254,253 | A | 3/1981 | Brent, Jr. et al. |
| 4,568,736 | A | 2/1986 | Curatolo et al. |
| 4,591,468 | A | 5/1986 | Follows et al. |
| 4,609,721 | A | 9/1986 | Kirshenbaum et al. |
| 4,952,345 | A | 8/1990 | Rao et al. |
| 5,073,453 | A | 12/1991 | Knorr |
| 5,140,098 | A | 8/1992 | Pipper et al. |
| 5,234,644 | A | 8/1993 | Schutze et al. |
| 5,236,652 | A | 8/1993 | Kidder |
| 5,237,755 | A | 8/1993 | Lowe |
| 5,292,865 | A | 3/1994 | Kerpes et al. |
| 5,434,223 | A | 7/1995 | Scheetz et al. |
| 5,461,141 | A | 10/1995 | Sheetz |

FOREIGN PATENT DOCUMENTS

| | | |
|---|---|---|
| EP | 0 002 717 A1 | 7/1979 |
| WO | WO 94/21711 A1 | 9/1994 |
| WO | WO 98/23666 A1 | 4/1998 |

OTHER PUBLICATIONS

John W. Doub, Jr., How to dry resins for optimum parts and trouble–free processing, Plastics Engineering, Jun. 1983.

Rangarajan Srinivasan, Prashant Desai, A.S. Abhiraman and Raymond S. Knorr, Solid–State Polymerization Vis–a–Vis Fiber Formation of Step–Growth Polymers. I. Results from a Study of Nylon 66, Journal of Applied Polymer Science, 53, 1731–1743, 1994.

*Primary Examiner*—Leo B. Tentoni

(57) ABSTRACT

The present invention relates to industrial high relative viscosity (RV) filaments, such as, for use in papermaking machine felts and other staple fiber applications. The invention is further directed to apparatus and processes for solid phase polymerization (SPP) of polyamide flake suitable for use, such as, in remelting and then spinning the industrial high RV filaments. The invention is also directed to processes for melt phase polymerization (MPP) of molten polymer for making the filaments.

4 Claims, 6 Drawing Sheets

PROCESS OF MAKING HIGH RV POLYAMIDE FILAMENTS

This Application claims priority from and incorporates by reference in its entirety U.S. Provisional Application No. 60/106,771 filed Nov. 3, 1998 and U.S. Nonprovisional application Ser. No. 09/428,327 filed Oct. 27, 1999, which was allowed on Dec. 4, 2000 and issued as U.S. Pat. No. 6,235,390.

BACKGROUND OF THE INVENTION

1. Field of the Invention

This invention relates to industrial high relative viscosity (RV) filaments, such as, for use in papermaking machine felts, apparatus and processes for solid phase polymerizing polyamide flake suitable for use in making the filaments, and processes for making the filaments.

2. Description of Related Art

Industrial polyamide filaments are used in, among other things, tire cords, airbags, netting, ropes, conveyor belt cloth, felts, filters, fishing lines, and industrial cloth and tarps. When used as staple fibers for papermaking machine felts, the fibers must have generally good resistance to chemicals and generally good wear resistance (e.g., resistance to abrasion, impact and flex fatigue). Such felts are often exposed to oxidizing aqueous solutions which can seriously shorten the service life of the felt.

Stabilizers are often added to polyamides for the purpose of increasing chemical resistance. The amount of stabilizer which can be introduced is limited, however, due to excess foaming that occurs during polymerization when stabilizers are added to autoclaves or continuous polymerizers (CPs).

It is also desirable to spin filaments which have a high RV to improve resistance to chemicals and to wear from abrasion, impact and flexing. However, in the past, when the polyamide supply for such filaments is polyamide flake, it was often difficult, if not impossible, to obtain the desired high RV while maintaining polymer quality, e.g., low level of cross linking and/or branching.

One way to increase the RV is to increase the amount of catalyst during polymerization in an autoclave, continuous polymerizer (CP), or elsewhere in the process, but this causes process and/or product problems. Difficulties, for instance, similar to those encountered with stabilizers can occur when catalysts are added in high quantities. Further, high quantities of catalysts in the autoclave can cause severe injection port pluggage and complications to injection timings during autoclave cycles. High quantities of catalysts injected into CPs place stringent demands on equipment capability because of high levels of water loading.

In U.S. Pat. No. 5,236,652, Kidder discloses such a process for making polyamide fibers for use as staple for papermaking machine felt. This process comprises (i) melt-blending polyamide flake with a polyamide additive concentrate which is made of a polyamide flake and an additive selected from the group of stabilizers, catalysts and mixtures thereof, and (ii) extruding the melt-blended mixture from a spinneret to form the higher RV fibers. Processes that add catalyst concentrate to polyamide flake, like the Kidder process, require special feed apparatus for metering the concentrate to the flake which significantly increases the expense of operating such a process. Further, adding high concentrations of catalyst to the polyamide often results in process and/or product control difficulties. Cross linking and/or branching of the fiber, and more susceptibility to chemical attack are liabilities of using high catalyst levels in polyamides.

Another way to increase the RV is through solid phase polymerization (SPP) of the polymer. In U.S. Pat. No. 5,234,644, Schutze et al. disclose a post spin SPP process for making high RV polyamide fibers for use in paper machinery webs. In this case, in contrast to prior staple fiber manufacturing processes, the post spin SPP process requires an added step after spinning the fibers with special processing equipment to increase the RV of the fibers. This special equipment adds a significant cost to the producer and the added post spinning step takes additional time to make the fibers. Furthermore, uniform fiber property control is more difficult when the post spinning SPP step is performed in a batch mode.

Thus, there is a long felt need for filaments with higher RV polyamide than previously made, and apparatus and processes for making the filaments for industrial uses, such as, in making papermaking machine felts, without process and product problems, such as those described above.

These and other objects of the invention will be clear from the following description.

SUMMARY OF THE INVENTION

The invention relates to a filament for use in papermaking machine felts, comprising:

- a synthetic melt spun polyamide polymer;
- a formic acid relative viscosity of at least about 140;
- a denier of about 2 to about 80 (a decitex of about 2.2 to about 89);
- a tenacity of about 4.5 grams/denier to about 7.0 grams/denier (about 4.0 cN/dtex to about 6.2 cN/dtex), and the percent retained tenacity
  - (i) is greater than or equal to about 50% when immersed for 72 hours at 80° C. in an aqueous solution of 1000 ppm of NaOCl,
  - (ii) is greater than or equal to about 50% when immersed for 72 hours at 80° C. in an aqueous solution of 3% hydrogen peroxide, or
  - (iii) is greater than or equal to about 75% when heated at 130° C. for 72 hours.

The invention is further related to an apparatus for solid phase polymerizing polymer flake having a polyamidation catalyst dispersed within the flake and a formic acid relative viscosity of about 40 to about 60 by contacting the flake with substantially oxygen free inert gas, comprising:

- a solid phase polymerization assembly for increasing the relative viscosity of the flake, the assembly having:
  - a vessel with a flake inlet for receiving the flake, a flake outlet for removing the flake after being solid phase polymerized, a gas inlet for receiving the gas, and a gas outlet for discharging the gas; and
  - a gas system for circulating the gas through interstices between the flake in the vessel, the gas system having:
    - a filter for separating and removing dust and/or polymer fines from the gas,
    - a gas blower for circulating the gas,
    - a heater for heating the gas, and
    - a first conduit connecting, in series and in turn, the gas outlet, the filter, the blower, the heater, and the gas inlet; and
  - a serially connected dual desiccant bed regenerative drying system connected in parallel with the first conduit between the blower and the gas inlet, the drying system for lowering the dew point temperature of at least a portion of the circulating gas such that the dew point temperature of the gas at the gas inlet is no more than about 20° C., whereby solid state polymerization of the flake occurs increasing its formic acid relative viscosity while the gas is circulated through interstices between, thereby contacting, the flake in the vessel at a temperature of about 120° C. to about 200° C. for about 4 hours to about 24 hours, after which flake having a formic acid relative viscosity of at least about 90 can be removed from the flake outlet.

The invention is also directed to a process for solid phase polymerizing polymer flake having a polyamidation catalyst dispersed within the flake and a formic acid relative viscosity of about 40 to about 60 utilizing substantially oxygen free inert gas, comprising:

feeding the flake into a solid phase polymerization vessel;

separating and removing dust and/or polymer fines from the gas;

drying at least a portion of the gas with a serially connected dual desiccant bed regenerative drying system such that the gas entering the vessel has a dew point of no more than about 20° C.;

heating the gas to a temperature of about 120° C. to about 200° C.;

circulating the filtered, dried, heated gas through interstices between the flake in the vessel for about 4 to about 24 hours; and removing the flake having a formic acid relative viscosity of at least about 90.

The invention is further directed to a process for melt phase polymerization of polymer for making filaments for use in making staple fibers for papermaking machine felts, comprising:

feeding polymer flake at a temperature of about 120° C. to about 180° C., into a non vented melt-extruder, the flake comprising:

a synthetic melt spinnable polyamide polymer, a formic acid relative viscosity of about 90 to about 120, and a polyamidation catalyst dispersed within the flake;

melting the flake in the melt-extruder and extruding molten polymer from an outlet of the melt-extruder to a transfer line wherein the temperature of the molten polymer in the transfer line within about 5 feet (2.4 m) of the outlet of the melt-extruder is about 290° C. to about 300° C.;

conveying the molten polymer through the transfer line to at least a spinneret of at least a spinning machine such that the temperature in the transfer line within 5 feet (2.4 m) of the at least a spinneret is about 292° C. to about 305° C., with a residence time in the melt-extruder and the transfer line of about 3 to about 15 minutes; and spinning the molten polymer through the at least a spinneret forming a plurality of the filaments having a formic acid relative viscosity of at least about 140.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
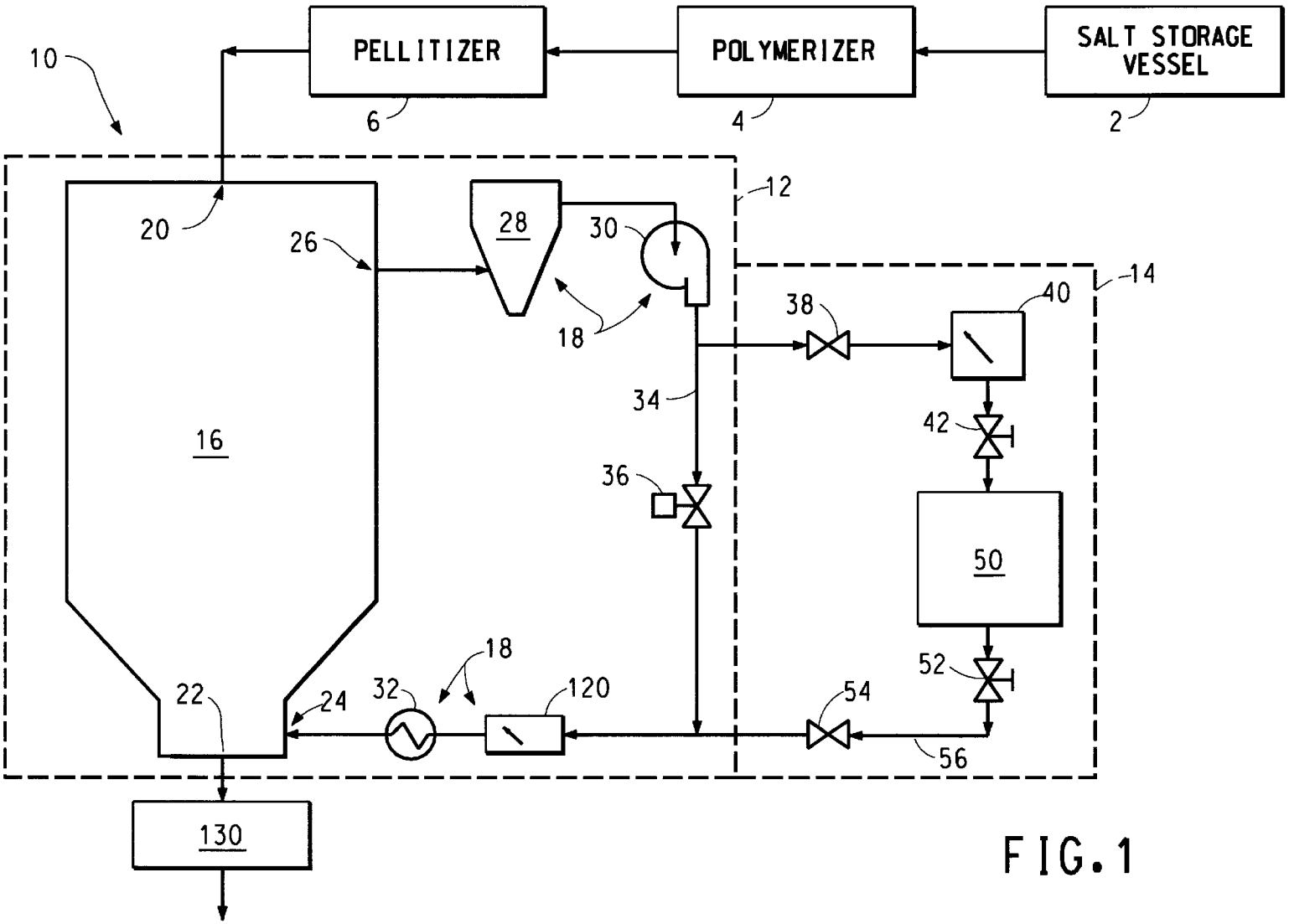
FIG. 1 is a schematic illustration of an apparatus for solid phase polymerizing polymer flake.

Throughout the following detailed description, similar reference characters refer to similar elements in all figures of the drawings.

The invention is directed to industrial high relative viscosity (RV) filaments, such as, for use in papermaking machine felts and other staple fiber applications. The invention is further directed to apparatus and processes for solid phase polymerization (SPP) of polyamide flake suitable for use, such as, in remelting and then spinning the industrial high RV filaments. For purposes herein, the term "solid phase polymerization" or "SPP" means increasing the RV of polymer while in the solid state. Also, herein increasing polymer RV is considered synonymous with increasing polymer molecular weight. The invention is also directed to processes for melt phase polymerization (MPP) of molten polymer for making the filaments. For purposes herein, the term "melt phase polymerization" or "MPP" means increasing the RV (or the molecular weight) of polymer while in the liquid state.

Industrial High RV Filaments

Industrial high RV filaments of the present invention comprising a synthetic melt spun polyamide polymer; a formic acid RV of at least about 140; a denier of about 2 to about 80 (a decitex of about 2.2 to about 88); and a tenacity of about 4.0 grams/denier to about 7.0 grams/denier (about 3.5 cN/dtex to about 6.2 cN/dtex). Further, the percent retained tenacity of the filaments (i) is greater than or equal to about 50% when immersed for 72 hours at 80° C. in an aqueous solution of 1000 ppm of NaOCl, (ii) is greater than or equal to about 50% when immersed for 72 hours at 80° C. in an aqueous solution of 3% hydrogen peroxide, or (iii) is greater than or equal to about 75% when heated at 130° C. for 72 hours.

For purposes herein, the term "industrial filament" means a filament having a formic acid RV of at least about 70; a denier of at least about 2 (a decitex of about 2.2); and a tenacity of about 4.0 grams/denier to about 11.0 grams/denier (about 3.5 cN/dtex to about 9.7 cN/dtex).

Polymer suitable for use in this invention consists of synthetic melt spinnable or melt spun polymer. The polymers can include polyamide homopolymers, copolymers, and mixtures thereof which are predominantly aliphatic, i.e., less than 85% of the amide-linkages of the polymer are attached to two aromatic rings. Widely-used polyamide polymers such as poly(hexamethylene adipamide) which is nylon 6,6 and poly(e-caproamide) which is nylon 6 and their copolymers and mixtures can be used in accordance with the invention. Other polyamide polymers which may be advantageously used are nylon 12, nylon 4,6, nylon 6,10, nylon 6,12, nylon 12,12, and their copolymers and mixtures. Illustrative of polyamides and copolyamides which can be employed in the process of this invention are those described in U.S. Pate. Nos. 5,077,124, 5,106,946, and 5,139,729 (each to Cofer et al.) and the polyamide polymer mixtures disclosed by Gutmann in Chemical Fibers International, pages 418–420, Volume 46, December 1996.

The filaments can include one or more polyamidation catalyst. Polyamidation catalysts suitable for use in a solid phase polymerization (SPP) process and/or a (re)melt phase polymerization (MPP) process which can be performed in making the filaments are oxygen-containing phosphorus compounds including those described in Curatolo et al., U.S. Pat. No. 4,568,736 such as phosphorous acid; phosphonic acid; alkyl and aryl substituted phosphonic acids; hypophosphorous acid; alkyl, aryl and alkyl/aryl substituted phosphinic acids; phosphoric acid; as well as the alkyl, aryl and alkyl/aryl esters, metal salts, ammonium salts and ammonium alkyl salts of these various phosphorus containing acids. Examples of suitable catalysts include $X(CH_2)_n PO_3R_2$, wherein X is selected from 2-pyridyl, —$NH_2$, NHR', and $N(R')_2$, n=2 to 5, R and R' independently are H or alkyl; 2-aminoethylphosphonic acid, potassium tolylphosphinate, or phenylphosphinic acid. Preferred catalysts include 2-(2'-pyridyl) ethyl phosphonic acid, and metal hypophosphite salts including sodium and manganous hypophosphite. It may be advantageous to add a base such as an alkali metal bicarbonate with the catalyst to minimize thermal degradation, as described in Buzinkai et al., U.S. Pat. No. 5,116,919.

An effective amount of the catalyst(s) is dispersed in the filaments. Generally the catalyst is added, and therefore present, in an amount from about 0.2 moles up to about 5 moles per million grams, mpmg, of polyamide (typically about 5 ppm to 155 ppm based on the polyamide). Preferably, the catalyst is added in an amount of about 0.4 moles to about 0.8 moles million grams, mpmg, of polyamide (about 10 ppm to 20 ppm based on the polyamide). This range provides commercially useful rates of solid phase polymerization and/or remelt phase polymerization under the conditions of the current invention, while minimizing deleterious effects which can occur when catalyst is used at higher levels, for example pack pressure rise during subsequent spinning.

For effective solid phase polymerization, it is necessary for the catalyst to be dispersed in the polyamide flake. A particularly convenient method for adding the polyamidation catalyst is to provide the catalyst in a solution of polymer ingredients in which polymerization is initiated, e.g., by addition to a salt solution such as the hexamethylene-diammonium adipate solution used to make nylon 6,6.

The filaments can optionally contain usual minor amounts of additives, such as plasticizers, delustrants, pigments, dyes, light stabilizers, heat and/or oxidation stabilizers, antistatic agents for reducing static, additives for modifying dye ability, agents for modifying surface tension, etc.

The filaments have a formic acid RV of at least about 140. (This converts to a molecular weight of at least about 25,000 number average molecular weight.) More preferred, the filaments have a formic acid RV of about 140 to about 190. Most preferred, the filaments have a formic acid RV of about 145 to about 170. The formic acid RV of polyamides as used herein refers to the ratio of solution and solvent viscosities measured in a capillary viscometer at 25° C. The solvent is formic acid containing 10% by weight of water. The solution is 8.4% by weight polyamide polymer dissolved in the solvent. This test is based on ASTM Standard Test Method D 789. Preferably, the formic acid RVs are determined on spun filaments, prior to drawing and can be referred to as spun fiber formic acid RVs. The RV of polyamide filaments can decrease from about 3% to about 7% upon drawing at the draw ratios described herein, but the RV of the drawn filaments will be substantially the same as the spun fiber RVs. The formic acid RV determination of a spun filament is more precise than the formic acid RV determination of a drawn filament As such, for purposes herein, the spun fiber RVs are reported and are considered a reasonable estimate of the drawn fiber RVs. The RV of the filaments achievable with this invention exceeds what is possible with prior art processes.

The filaments when drawn have a denier per filament (dpf) of about 2 to about 80 (a dtex per filament of about 2.2 to about 89). These deniers are preferably measured deniers based on ASTM Standard Test Method D 1577.

The filaments, when drawn, have a tenacity of about 4.0 grams/denier to about 7.0 grams/denier (about 3.5 cN/dtex to about 6.2 cN/dtex). Preferably, the filaments have a tenacity of about 4.5 grams/denier to about 6.5 grams/denier (about 4.0 cN/dtex to about 5.7 cN/dtex). Further, the percent retained tenacity of the filaments (i) is greater than or equal to about 50% when immersed for 72 hours at 80° C. in an aqueous solution of 1000 ppm of NaOCl, (ii) is greater than or equal to about 50% when immersed for 72 hours at 80° C. in an aqueous solution of 3% hydrogen peroxide, or (iii) is greater than or equal to about 75% when heated at 130° C. for 72 hours. It is more preferred that the filaments have a percent retained tenacity which is greater than about 50% when immersed for 72 hours at 80° C. in an aqueous solution of 1000 ppm of NaOCl. It is most preferred that the filaments have a percent retained tenacity which (i) is greater than about 50% when immersed for 72 hours at 80° C. in an aqueous solution of 1000 ppm of NaOCl, (ii) is greater than about 50% when immersed for 72 hours at 80° C. in an aqueous solution of 3% hydrogen peroxide, and (iii) is greater than about 75% when heated at 130° C. for 72 hours.

For purposes herein, the term "filament" is defined as a relatively flexible, macroscopically homogeneous body having a high ratio of length to width across its cross-sectional area perpendicular to its length. The filament cross section can be any shape, but is typically circular. Herein, the term "fiber" is used interchangeably with the term "filament".

The filaments can be any length. The filaments can be cut into staple fibers having a length of about 1.5 to about 5 inches (about 3.8 cm to about 12.7 cm).

The staple fiber can be straight (i.e., non crimped) or crimped to have a saw tooth shaped crimp along its length, with a crimp (or repeating bend) frequency of about 3.5 to about 18 crimps per inch (about 1.4 to about 7.1 crimps per cm).

Apparatus and Process for SPP of Polymer Flake

The invention is further directed to an SPP apparatus 10 and SPP process for solid phase polymerization of flake made of the polymer which is suitable for use in making the filaments of the present invention.

The polymer flake can be prepared using batch or continuous polymerization methods known in the art, pelletized, and then fed to the SPP apparatus 10. As illustrated in FIG.

1, a typical example is to store a polyamide salt mixture/solution in a salt storage vessel 2. The salt mixture/solution is fed from the storage vessel 2 to a polymerizer 4, such as a continuous polymerizer or a batch autoclave. The desired additives mentioned above plus at least one of the previously mentioned polyamidation catalysts can be added simultaneously with the salt mixture/solution or separately. In the polymerizer 4, the polyamide salt mixture/solution is heated under pressure in a substantially oxygen free inert atmosphere as is known in the art. The polyamide salt mixture/solution is polymerized into molten polymer which is extruded from the polymerizer 4, for example, in the form of a strand. The extruded polymer strand is cooled into a solid polymer strand and fed to a pelletizer 6 which cuts, casts or granulates the polymer into flake.

Other terms used to refer to this "flake" include pellets and granulates. Most conventional shapes and sizes of flake are suitable for use in the current invention. One typical shape and size comprises a pillow shape having dimensions of approximately ⅜ inch (9.5 mm) by ⅜ inch (9.5 mm) by 0.1 inch (0.25 mm). Alternatively, flake in the shape of right cylinders having dimensions of approximately 90 mils by 90 mils (2.3 mm by 2.3 mm) are convenient. Thus, it should be appreciated that the polyamide can be shaped and fed into the SPP apparatus 10 in other particulate forms than flake and all such particulate forms are amenable to the improved SPP process of the instant invention.

The polymer flake has one or more of the polyamidation catalysts previously mentioned dispersed within the flake. The flake has a formic acid RV of about 40 to about 60. (This converts to a molecular weight range of about 10,000 number average molecular weight to about 14,000 number average molecular weight.) More preferably, it has a formic acid RV of about 40 to about 50. Most preferably, it has a formic acid RV of about 45 to about 50. Further, the flake can contain variable amounts of absorbed water.

The SPP apparatus 10 comprises a SPP assembly 12 and a serially connected dual desiccant bed regenerative drying system 14. The SPP assembly 12 has a SPP vessel 16 and a gas system 18.

The SPP vessel 16, otherwise known in the art as a flake conditioner, has a flake inlet 20 for receiving the flake, a flake outlet 22 for removing the flake after being solid phase polymerized in the SPP vessel 16, a gas inlet 24 for receiving circulating gas, and a gas outlet 26 for discharging the gas. The flake inlet 20 is at the top of the SPP vessel 16. The flake outlet 22 is at the bottom of the SPP vessel 16. The gas inlet 24 is towards the bottom of the SPP vessel 16. Whereas, the gas outlet 26 is towards the top of the SPP vessel 16. The flake can be fed one batch at a time or continuously into the flake inlet 20 of the SPP apparatus 10. The flake can be fed into the SPP apparatus 10 at room temperature or preheated. In a preferred embodiment, the SPP vessel 16 can contain up to about 15,000 pounds (6,800 kilograms) of the flake.

The gas system 18 is for circulating substantially oxygen free inert gas, such as nitrogen, argon, or helium, into the gas inlet 24, through interstices between, thereby contacting, the flake in the SPP vessel 16, and then out the gas outlet 26. Thus, the gas circulates upwardly through the SPP vessel 16 counter current to the direction of flake flow when the process continually feeds flake into the flake inlet 20 and removes flake from the flake outlet 22 of the SPP vessel 16. The preferred gas is nitrogen. Atmospheres containing other gases, for example nitrogen containing low levels of carbon dioxide, can also be used. For purposes of the present invention, the term "substantially oxygen free" gas refers to a gas containing at most about 5000 ppm oxygen when intended for use at temperatures of the order of 120° C. down to containing at most about 500 ppm oxygen for applications approaching 200° C. and containing as low as a few hundred ppm oxygen for some applications highly sensitive to oxidation.

The gas system 18 has a filter 28 for separating and removing dust and/or polymer fines from the gas, a gas blower 30 for circulating the gas, a heater 32 for heating the gas, and a first conduit 34 connecting, in series and in turn, the gas outlet 26, the filter 28, the blower 30, the heater 32, and the gas inlet 24.

The filter 28 removes fine dust generally comprising volatile oligomers which have been removed from the flake and subsequently precipitated out as the gas has cooled. A suitable filter 28 is a particulate cyclone separator that impinges circulating gas on a plate causing solids to drop out, such as described on pages 20–81 through 20–87 of the Chemical Engineers' Handbook, Fifth Edition, by Robert H. Perry and Cecil H. Chilton, McGraw-Hill Book Company, NY, N.Y., published 1973. Alternatively, filters of nominally 40 microns or less are sufficient to remove the fine powder that can be created in the process. It is preferred to remove the volatile oligomers before the gas passes through desiccant beds of the drying system 14 as they can be a fire hazard during regeneration of the desiccant.

Preferably, the blower 30 is adapted to force a substantially constant amount of the gas per unit time through the SSP vessel 16 while maintaining pressure of the gas in the drying system 14 at about 2 psig to about 10 psig (about 14 kilopascals to about 70 kilopascals) and to maintain gas flow and positive pressure in the SPP vessel 16. The blower 30 can heat the circulating gas up several degrees Celsius or more depending on the make and model of the blower 30 that is used. In a preferred embodiment, the blower 30 is adapted to circulate gas through the SPP vessel 16 at a rate of about 800 to about 1800 standard cubic feet per minute (about 23 cubic meters per minute to about 51 cubic meters per minute). Gas flow is maintained low enough to preclude fluidization of the flake.

The heater 32 is adapted to heat the gas in the SPP vessel 16 to a temperature of about 120° C. to about 200° C., preferably, about 145° C. to about 190° C., and most preferably to about 150° C. to about 180° C. The gas is generally heated to provide the thermal energy to heat the flake. At the gas inlet 24, temperatures below about 120° C., require the flake residence time in the SPP vessel 16 to be too long and/or require the use of undesirably large solid phase polymerization vessels. Gas inlet temperatures greater than 200° C. can result in thermal degradation and agglomeration of the flake. The temperature of the gas existing the SPP vessel 16 through the gas outlet 26 can be at or below 100° C. requiring reheating by the heater 32 before reentry to the SPP vessel 16.

The serially connected dual desiccant bed regenerative drying system 14 is connected in parallel with the first conduit 34 between the blower 30 and the gas inlet 24. The drying system 14 is for drying the circulating gas increasing the removal of water from the flake in the SPP vessel 16. Water removal in turn drives the condensation reaction of the polyamide flake towards higher RV. Thus, the drying system 14 is for drying and lowering the dew point temperature of at least a portion of the circulating gas such that the dew point temperature of the gas at the gas inlet 24 is no more than about 20° C. More preferred, the dew point temperature of the gas at the gas inlet 24 is about −20° C. to about 20° C. Most preferred, the dew point temperature of the gas at the gas inlet 24 is about 5° C. to about 20° C. The dew point temperature of the gas exiting the SPP vessel 16 through the gas outlet 26 can be above 30° C. and in need of drying. The portion of the gas that is passed through the drying system 14 can be up to 100% of the total gas stream circulated through the SPP vessel 16. However, if less than 100% of the total gas stream is bypassed through the drying system 14, then the dew point temperature at the gas inlet 24 can be controlled more accurately with a lower capacity, and therefore less expensive, drying system. Further, adjusting the portion of the gas being dried provides a fine quantity control for selecting and controlling the RV of the flake removed from the SPP vessel 16. Such adjustments provide useful means for producing uniform RV flake. Thus, it is more preferred that the portion of the gas that is passed through the drying system 14 is about 50% to about 100% of the total gas stream circulated through the SPP vessel 16. Most preferred, the portion of the gas that is passed through the drying system 14 is about 70% to about 90% of the total gas stream circulated through the SPP vessel 16.

Preferably, the drying system 14 is connected in parallel with the first conduit 34 and between the blower 30 and the heater 32. There can be an adjustable valve 36 connected in the first conduit 34 between the blower 30 and the heater 32. Then the drying system 14 can be connected in parallel with the adjustable valve 36.

The drying system 14 comprises an optional first valve 38, an optional gas flow meter 40, an optional second valve 42, a serially connected dual desiccant bed regenerative dryer 50, an optional third valve 52, an optional fourth valve 54, and a second conduit 56 interconnecting, in turn, the first conduit 34 (preferably between the blower 30 and the adjustable valve 36), the optional first valve 38, the optional gas flow meter 40, the optional second valve 42, the serially connected dual desiccant bed regenerative dryer 50, the optional third valve 52, the optional fourth valve 54, and the first conduit 34 (preferably between the adjustable valve 36 and the heater 32). The first and fourth valves 38,54 are useful if one wants to take the drying system 14 off line for maintenance work. As such, the first and fourth valves 38,54 can be, for instance, manual butterfly valves that are designed to be used in either a fully open or fully closed position. The second and third valves 42,52 are useful if one wants to isolate the dryer 50 from the remainder of the drying system 14 for maintenance or replacement of the dryer 50. The second and third valves 42,52 can be, for instance, manual isolation valves.

Figure 2:
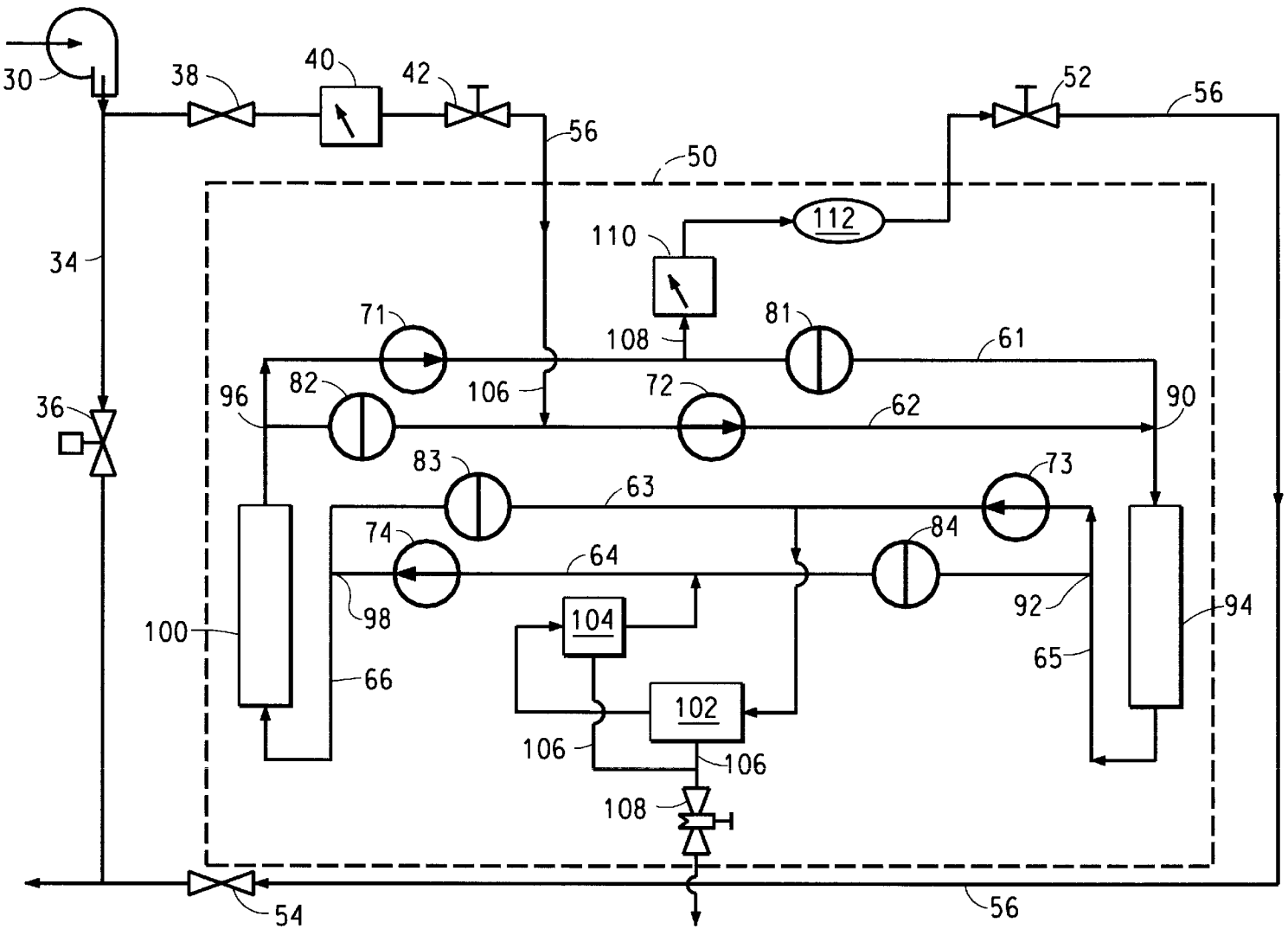
FIG. 2 is a schematic illustration of a serially connected dual desiccant bed regenerative drying system set to operate in a first mode.

FIG. 2 is a schematic illustration of a preferred embodiment of the serially connected dual desiccant bed regenerative dryer 50 set to operate in a first mode. The dryer 50 comprises a first gas line 61, a second gas line 62, a third gas line 63, a fourth gas line 64, a fifth gas line 65, a sixth gas line 66, and a seventh gas line 67. Each of the first, second, third and fourth gas lines 61–67 contain a first solenoid valve 71–74 and a second solenoid valve 81–84. The fifth line 65 interconnects a first junction 90 of the first line 61 and the second line 62 and a first junction 92 of the third line 63 and the fourth line 64. A first desiccant bed 94 is connected in the fifth line 65. The sixth line 66 interconnects a second junction 96 of the first line 61 and the second line 62 and a second junction 98 of the third line 63 and the fourth line 64. A second desiccant bed 100 is connected in the sixth line 66. The seventh line 67 connects, in turn, the third line 63 between its first solenoid valve 73 and its second solenoid valve 83, a cooling condenser 102, a liquid filter 104, and the fourth line 64 between its first solenoid valve 74 and its second solenoid valve 84. Drainage lines 106 are connected to the condenser 102 and the liquid filter 104 to allow liquid to drain. A valve 108 can be located to temporarily close the drainage lines 106, when desired. One end 106 of the second conduit 56 connects to the second line 62 between its first solenoid valve 72 and its second solenoid valve 82. Another end 108 of the second conduit 56 connects to the first line 61 between its first solenoid valve 71 and its second solenoid valve 81. After the end 108 of the second conduit 56 connects to the first line 61, the second conduit 56, in turn, connects an optional dew point temperature measurement instrument 110 for measuring the humidity of the gas, an optional particle filter 112, and then the second optional isolation valve 52. The first gas line 61 is connected at the junctions 90 and 96 in parallel with the second gas line 62. The third gas line 63 is connected at the junctions 92 and 98 in parallel with the fourth gas line 64.

In the first mode, depicted in FIG. 2, the adjustable valve 36 is adjusted, if necessary, to cause at least a portion of the total circulating gas to pass through valve 38 of the second conduit 56 towards the dryer 50. Further, in the first mode, all of the first solenoid valves 71–74 are open and all of the second solenoid valves 81–84 are closed. In this mode, the blower 30 forces gas, in turn, through the second conduit 56, the first solenoid valve 72 in the second line 62, the first desiccant bed 94, the first solenoid valve 73 in the third line 63, the condenser 102, the liquid filter 104, the first solenoid valve 74 in the fourth line 64, the second desiccant bed 100, the first solenoid valve 71 in the first line 61, the optional dew point temperature measurement instrument 110, and the remainder of the second conduit 56 back to the first conduit 34. In this manner, in the first mode, the first desiccant bed 94 and the second desiccant bed 100 are connected to operate in series with each other. In other words, both beds 94,100 are on line at the same time in that the residual heat of the circulating gas dries, thereby, regenerating the first desiccant bed 94 as the hot gas passes through the first desiccant bed 94 while the second desiccant bed 100 dries the gas which has already been substantially dried by the condenser 102 which cools the gas and separates and removes liquid from the gas. The liquid filter 104 removes small remaining liquid droplets from the gas. Being already regenerated, the second desiccant bed 100 absorbs liquid removing even more liquid from the gas reducing its dew point temperature to as low as minus 40° C.

Figure 3:
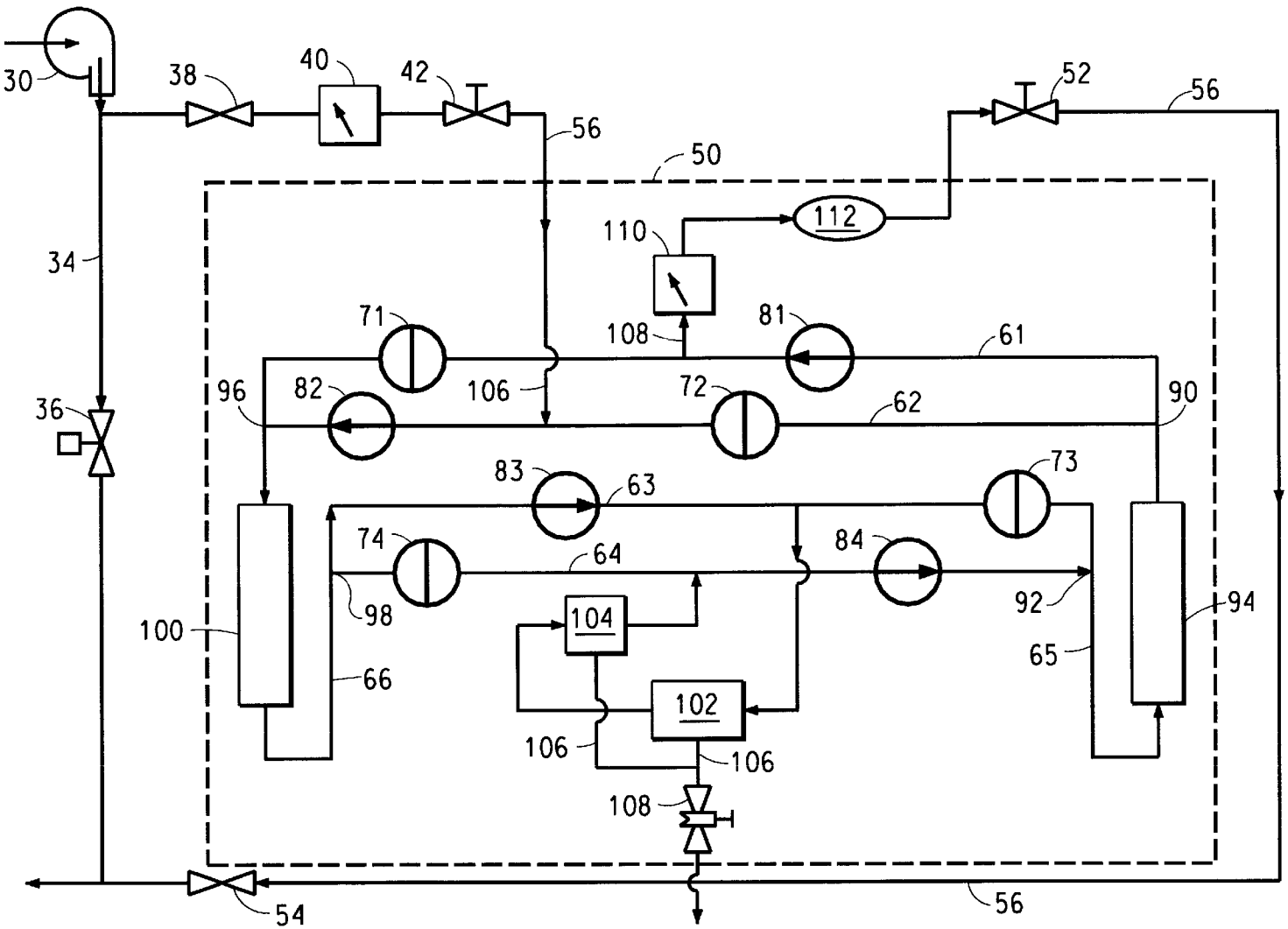
FIG. 3 is a schematic illustration of the serially connected dual desiccant bed regenerative drying system set to operate in a second mode.

After a set period of time, when the first desiccant bed 94 is dried by the heat of the gas and the second desiccant bed 100 becomes saturated or otherwise needs regeneration due to the liquid it has been absorbing, an operator or automatic controller (not depicted) causes the first solenoid valves 71–74 to close and causes the second solenoid valves 81–84 to open. This second mode of operation is depicted in FIG. 3. In this mode, the blower 30 forces gas, in turn, through the second conduit 56, the second solenoid valve 82 in the second line 62, the second desiccant bed 100, the second solenoid valve 83 in the third line 63, the condenser 102, the liquid filter 104, the second solenoid valve 84 in the fourth line 64, the first desiccant bed 94, the second solenoid valve 81 in the first line 61, the optional dew point temperature measurement instrument 110, and the remainder of the second conduit 56 back to the first conduit 34. In this manner, in the second mode, the first desiccant bed 94 and the second desiccant bed 100 are also connected to operate in series with each other, but in an opposite gas flow direction to that in the first mode of operation. In the second mode, the residual heat of the circulating gas dries, thereby, regenerating the second desiccant bed 100 as the hot gas passes through the second desiccant bed 100. The condenser 102 dries the gas by cooling it and separating and removing liquid from the gas. The liquid filter 104 removes small remaining liquid droplets from the gas. Being already regenerated in the first mode of operation, in the second mode the first desiccant bed 94 absorbs liquid removing even more liquid from the gas.

Utilizing the residual heat of the circulating gas to regenerate one of the desiccant beds 94,100 while the other is being used to dry the gas eliminates the need to take one bed off line to regenerate it with separate equipment including, such as, a filter, a blower and a heater. As a result, the present invention saves money and resources over such off line systems.

The first desiccant bed 94 and the second desiccant bed 100 contain an absorbent molecular sieve, such as sodium aluminosilicate, potassium sodium aluminosilicate and calcium sodium aluminosilicate, or the like, to dry the gas to the required dew point temperatures. Preferred desiccants are generally regenerated by heating at least about 100° C. for about 20 minutes or more which is accomplished in the present invention by the heat generated by the heater 32 and possibly the blower 30. A dryer 50 suitable for use in the drying system 14 is Sahara Dryer, model number SP-1800 commercially available from Henderson Engineering Company of Sandwich, Ill. This Sahara Dryer has a capacity of about 1000 cubic feet per minute (28 cubic meters per minute). If more capacity is desired, a larger capacity dryer can be used or two or more of the Sahara Dryer, model number SP-1800, can be connected in parallel within the drying system 14.

The portion of gas that passes through the drying system 14 continues through the second conduit 56 and is combined in the first conduit 34 with any circulating gas that was not passed through the drying system 14.

Referring back to FIG. 1, the SPP apparatus 10 can optionally include a dew point temperature measurement instrument 120 connected to the first conduit 34 for measuring the dew point temperature of the combined gas stream in the first conduit 34 downstream of the drying system 14. The dew point temperature measurement instrument 120 can be connected to the first conduit 34 downstream of the drying system 14, either before (as depicted in FIG. 1) or after the heater 120. In either case, the dew point temperature measurement instrument 120 should be positioned close enough to the gas inlet 24 to provide a measurement of the temperature at the gas inlet 24.

The SPP apparatus 10 is adapted such that solid state polymerization of the flake occurs in the SPP vessel 16 increasing its formic acid RV of the flake while the gas is filtered, dried, heated and circulated through the interstices between, thereby contacting, the flake in the SPP vessel 16 at a temperature of about 120° C. to about 200° C. for about 4 hours to about 24 hours, after which flake having a formic acid RV of at least about 90 can be removed from the flake outlet 22. More preferably, the flake residence time in the SPP vessel 16 is about 5 hours to about 15 hours, most preferably about 7 hours to about 12 hours. Preferably continuous drying of the flake in the SPP vessel 16 proceeds throughout the residence time. More preferably, the flake removed from the flake outlet 22 has a formic acid RV of about 90 to about 120, most preferably, of about 95 to about 105.

The SPP process comprises the following steps. First, the flake is fed into the SPP vessel 16. Second, dust and/or polymer fines is separated and removed from the gas by the filter 28. Third, at least a portion of the gas is dried with the serially connected dual desiccant bed regenerative drying system 14 such that the gas entering the SPP vessel 16 has a dew point temperature of no more than 20° C. Fourth, the gas is heated by the heater 32 to a temperature of about 120° C. to about 200° C. Fifth, the filtered, dried, heated gas is circulated by the blower 30 through interstices between the flake in the SPP vessel 16 for about 4 to about 24 hours. Sixth, the flake having a formic acid RV of at least about 90 is removed from the flake outlet 22 of the SPP vessel 16.

The flake having a formic acid RV of at least about 90 can be withdrawn from the flake outlet 22 at the same rate that flake is fed into the flake inlet 20 to maintain the flake volume in the SPP vessel 16 substantially the same.

Process for MPP of Molten Polymer

The invention further includes a MPP process for MPP of molten polymer for making the filaments. The MPP process comprises the following steps.

Figure 4:
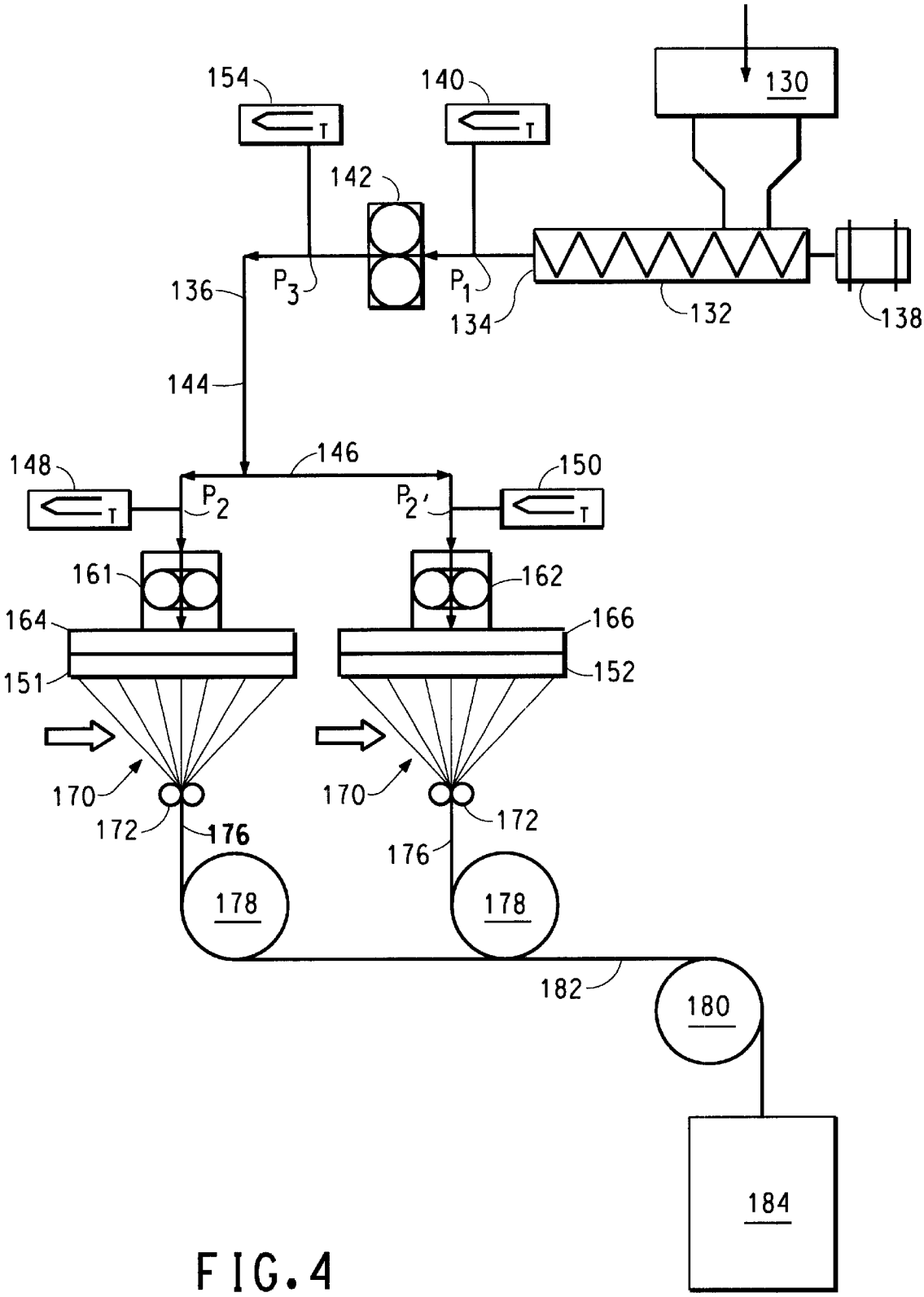
FIG. 4 is a schematic illustration of a portion of a fiber manufacturing process wherein flake is fed to a non vented melt-extruder, melted and extruded to a transfer line, conveyed through the transfer line to at least one spinneret, spun into filaments, converged into tows, and placed in a storage container.

As shown in FIGS. 1 and 4, the SPP apparatus 10 can optionally be coupled to a flake feeder 130 which, in turn, is coupled to feed the polymer flake at a temperature of about 120° C. to about 180° C. into a non vented melt-extruder 132. The flake feeder 130 can be, for instance, a gravimetric or volumetric feeder. In a preferred embodiment, the feeder 130 can provide a metered amount of the flake to the melt-extruder 132 in a range of about 1400 pounds per hour to about 1900 pounds per hour (635 kilograms per hour to about 862 kilograms per hour). The polyamide flake that is fed into the melt-extruder 132 comprises a formic acid RV of about 90 to about 120, and a polyamidation catalyst dispersed within the flake. Preferably, the flake has a formic acid RV of about 95 to about 105. Stabilizers or other additives can be added in the melt-extruder 132. Water can be added in the melt-extruder 132 for precise RV control in resulting filaments. Flake removed from the SPP assembly 10 is quite suitable for feeding into the melt-extruder 130. The melt-extruder can be a single screw melt-extruder, but preferably a double screw melt-extruder is used. A suitable double screw melt-extruder is included in melt-extruder assembly model number ZSK120 is commercially available from Krupp, Werner & Pfliederer Corporation at Ramsey, N.J.

The flake is melted in the melt-extruder 132 and molten polymer is extruded from an outlet 134 of the melt-extruder 132 to a transfer line 136. A motor assembly 138 rotates one or more screw device(s) in the melt-extruder 132 increasing the temperature of the polymer due to the mechanical work of the screw(s). As is known in the art, associated apparatus including insulation and/or heating elements maintain controlled temperature zones along the melt-extruder 132 allowing sufficient heat to melt, but not overheat, the polymer. This associated apparatus is part of the melt-extruder assembly mentioned above which is commercially available from Krupp, Werner & Pfliederer Corporation at Ramsey, N.J. Further, the polymer undergoes melt phase polymerization in the melt-extruder 132 and the transfer line 136 increasing the temperature of the polymer. As such, the temperature of the molten polymer in the transfer line 136 at point P1 within about 5 feet (2.4 m) of the outlet 134 of the melt-extruder 132 is about 290° C. to about 300° C., preferably about 291° C. to about 297° C. A temperature sensor 140 can be connected to the transfer line 136 at point P1 to measure this temperature.

The extruded molten polymer is conveyed, such as by a booster pump 142, through the transfer line 136 to at least a spinneret 151,152 of at least a spinning machine. The transfer line 136 includes a conduit 144 and a manifold 146. The conduit 136 connects the melt-extruder 132 to the manifold 146. The manifold 146 connects to each of the spinnerets 151,152. The temperature in the transfer line 136 (or, more specifically, the manifold 146 of the transfer line 136) at points P2,P2' within 5 feet (2.4 m) of the spinnerets 151,152 is about 292° C. to about 305° C., preferably, of about 294° C. to about 303° C. Additional temperature sensors 148,150 can be connected to the manifold 146 at points P2 and P2' to measure the temperatures at these points. An additional temperature sensor 154 can be connected to the transfer line 136 at point P3 between the booster pump 142 and the manifold 146 to obtain an additional temperature measurement. The residence time of the molten polymer in the melt-extruder 132 and the transfer line 136 is about 3 to about 15 minutes, and preferably about 3 to about 10 minutes.

Metering pumps 161,162 force the molten polymer from the manifold 146 through spin filter packs 164,166 and then the spinnerets 151,152, each having a plurality of capillaries through the spinneret 151,152 thereby spinning the molten polymer through the capillaries into a plurality of filaments 170 having a spun fiber formic acid RV of at least about 140, preferably of about 140 to about 190, and most preferably, of about 145 to about 170.

Preferably, the molten polymer is spun through a plurality of the spinnerets 151,152, each spinneret 151,152 forming a plurality of the filaments 170.

The filaments 170 from each spinneret 151,152 are quenched typically by an air flow (illustrated in FIG. 4 by arrows) transverse to t length of the filaments 170, converged by a convergence device 172, coated with a lubricating spin finish, into a continuous filament tow 176. The tows 176 are directed by feed rolls 178 and optionally one or more change of direction roll 180. The tows 176 can be converged together forming a larger continuous filament combined tow 182 which can be fed into a storage container 184, called a "can" by those skilled in the art.

Figure 5:
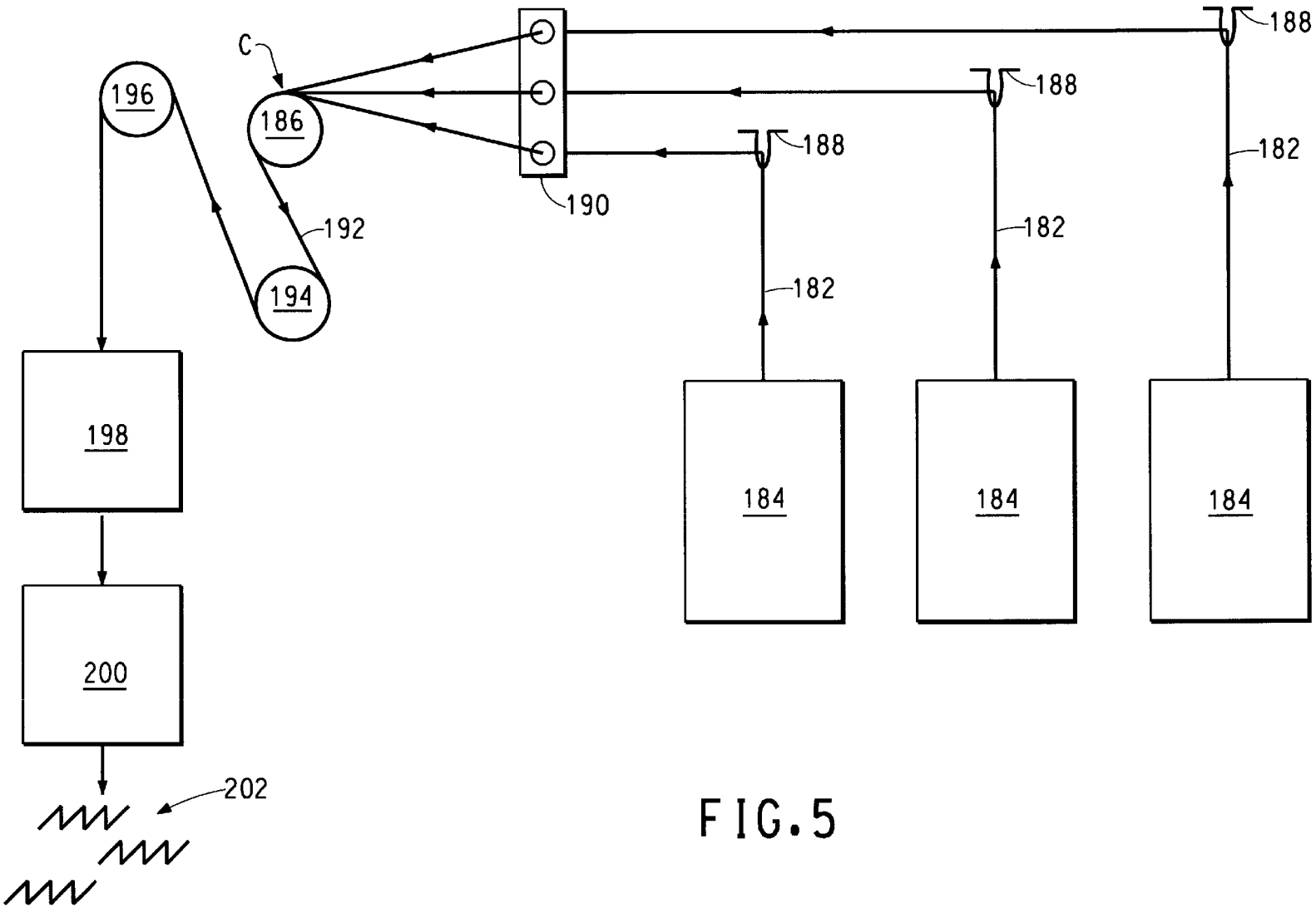
FIG. 5 is a schematic illustration of a portion of a fiber manufacturing process wherein tows are removed from a plurality of storage containers, combined into a tow band, drawn, crimped, and cut to form crimped staple fibers.

Referring to FIG. 5, the tows 182 can be removed by a feed roll 186 from several of the cans 184. The tows 182 can be directed by devices, such as wire loops 188 and/or a ladder guide 190 which is typically used to keep tows 182 spaced apart until desired. The tows 182 can be combined, such as at point C in FIG. 5, into a continuous filament tow band 192. Then the continuous filament tow band 192 can be drawn by contact with a draw roll 194 which rotates faster than the feed roll 186. The continuous filament tow band 192 can be drawn 2.5 to 4.0 times, according to known processes, to provide a drawn denier per filament (dpf) in a range of about 2 to about 80 (about 2.2 dtex/f to about 89 dtex/f). The continuous filament tow band 192 can typically have 20 to 200 thousand continuous filaments. If space requires, one or more change of direction roll(s) 196 can redirect the tow band 192. Then the continuous filament tow band 192 can be crimped by a crimping apparatus 198, such as by forcing the continuous filament tow band 192 into a stuffing box. Then the crimped drawn continuous filament tow band can be cut by a cutter 200 providing the staple fibers 202 of the present invention described above.

TEST METHODS

The following test methods were used in the following Examples.

Relative viscosity (RV) of nylons refers to the ratio of solution or solvent viscosities measured in a capillary viscometer at 25° C. (ASTM D 789). The solvent is formic acid containing 10% by weight water. The solution is 8.4% by weight polymer dissolved in the solvent.

Denier (ASTM D 1577) is the linear density of a fiber as expressed as weight in grams of 9000 meters of fiber. The denier is measured on a Vibroscope from Textechno of Munich, Germany. Denier times (10/9) is equal to decitex (dtex)

Denier, tenacity, fiber abrasion, and fiber flex fatigue tests performed on samples of staple fibers are at standard temperature and relative humidity conditions prescribed by ASTM methodology. Specifically, standard conditions mean a temperature of 70+/−2° F. (21+/−1° C.) and relative humidity of 65% +/−2%.

Tenacity (ASTM D 3822) is the maximum or breaking stress of a fiber as expressed as force per unit cross-sectional area. The tenacity is measured on an Instron model 1130 available from Instron of Canton, Mass. and is reported as grams per denier (grams per dtex).

In all testing done to predict fiber performance in press felts (i.e., in the fiber abrasion tests, the fiber flex fatigue tests, and the chemical exposure tests), spin finish on the fibers is removed prior to testing by scouring the fibers in hot water with a cleaning agent.

Figure 6:
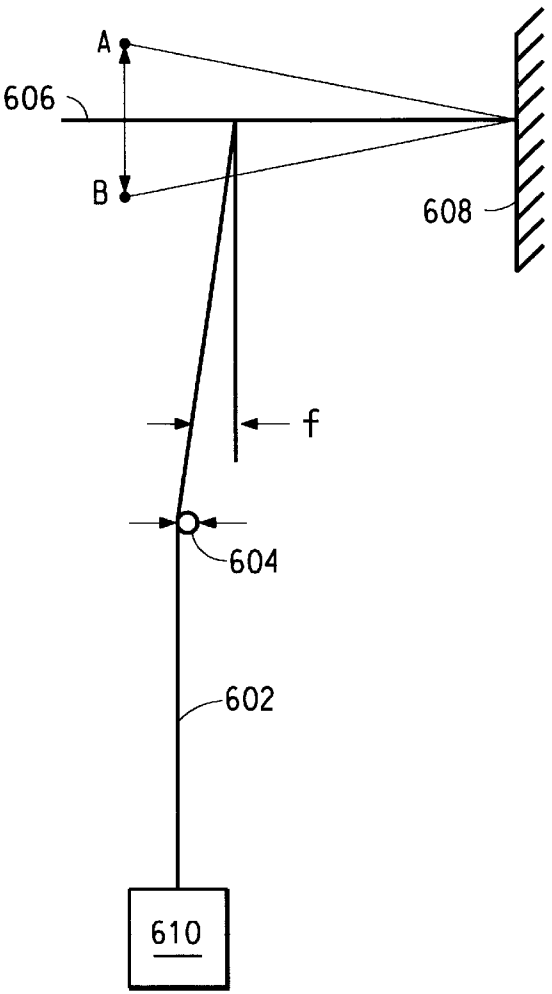
FIG. 6 is a schematic illustration of apparatus for performing a fiber abrasion test as described herein.

A fiber abrasion test, which is schematically illustrated in FIG. 6, was developed to compare the resistance of staple fibers 602 to abrasion when the fibers 602 are worn across a metal wire 604. A sample of staple fibers 602 is tied or otherwise secured to a rod 606 with one end of the rod 606 mounted on a fixed support 608 so that the sample fibers 602 is in contact with the wire 604. The wire 604 has a 0.004 inch (0.10 mm) diameter and is made of stainless steel. The sample of fibers 602 is mounted so that a deflection angle θ of the sample of fibers 602 from a vertical line across the wire is 7° of arc and is consistent from fiber sample 602 to fiber sample 602. The end of the fiber sample 602 secured to the rod 606 is made to oscillate vertically between points A and B. An approximate 0.6 grams/denier (0.07 gm/dtex) tension is maintained by suspending a weight 610 on the other end of the fiber sample 602. As the end of the fiber sample 602 which is attached to the rod 606 is oscillated, a small section of the fiber sample 602 (which is 0.035 inch or 0.89 mm long) in contact with the wire 604 is moved back and forth across the wire 604 at a low frequency. The low frequency minimizes the impact of temperature on the test. The fiber sample 602 is abraded until it breaks, and the number of cycles to failure is automatically recorded. A cycle is one back and forth movement of the fiber sample 602 in contact with the wire 604. Ten fibers are tested per sample, and an average number of cycles to failure of the ten tested in the sample is reported.

Figure 7:
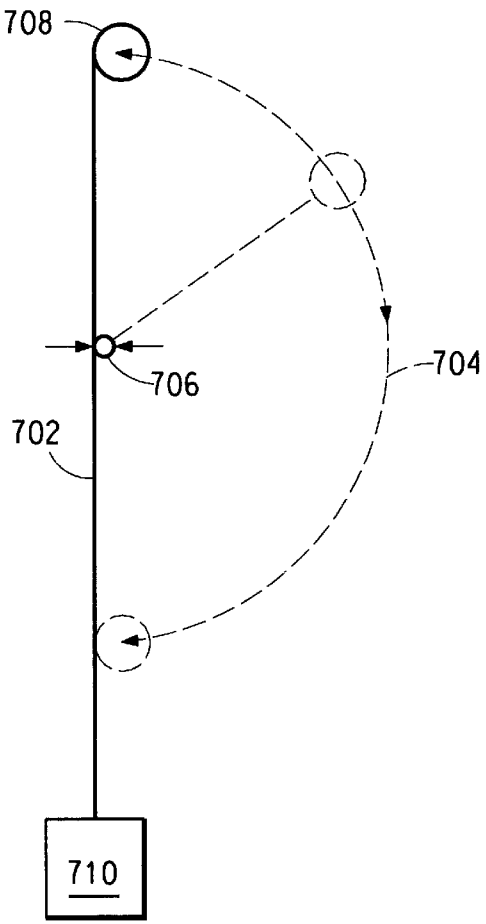
FIG. 7 is a schematic illustration of apparatus for performing a fiber flex fatigue test as described herein.

The fiber flex fatigue test, illustrated by FIG. 7, repeatedly bends a fiber 702 through a 180° semicircle 704 over a stationary 0.003 inch (0.08 mm) diameter tungsten wire 706. One end of the fiber 702 is attached to a bar 708 on a test stand (not depicted) with a clamp (not depicted) or otherwise. The fiber 702 is then hung vertically to contact the wire on a side of the wire opposite the semicircle 704. The other end of the fiber 702 is tensioned by attaching a weight 710, and allowing the fiber 702 to hang freely. Typically a tension of 0.6 grams/denier (0.7 gm/dtex) is used for nylon fibers. To allow for the increased strength of the high molecular weight fibers the tension was increased to 0.9 grams/denier (1.0 gm/dtex). This reduces the testing time to a reasonable period. Once the test starts the bar 708 is moved back and forth in a manner which flexes the fibers along the semicircular arc of 180°. The frequency of this motion is high. A total of 21 fibers are mounted for one test. After 11 fibers have failed (broken), the test is stopped automatically. The test is run three times for each sample, and the average of the three tests is recorded and reported as the median cycles to failure. A median is used to judge fibers since experience shows that for a given sample a small percentage of fibers can last for an extremely high number of cycles. These few fibers can skew the average, plus they extend the test period to an unreasonable length.

In chemical exposure testing, samples of staple fiber are exposed to aqueous solutions of 3% hydrogen peroxide and 1000 ppm sodium hypochlorite. Hydrogen peroxide and sodium hypochlorite simulate the strong oxidative media in typical papermaking conditions. However, these test concentrations are much higher than would typically be experienced on a papermachine. These higher concentrations magnify differences in strength retention of the fibers. Sample staple fibers are exposed for 72 hours. The temperature is maintained at 80° C. by use of a hot water bath. After 72 hours the fibers are dried with ambient air. The thermal exposure testing is done by exposing small samples of fibers to 130° C. for 72 hours in an oven. The 130° C. temperature is significantly higher than what the fiber would see on a typical papermachine. In the case of the chemical and thermal exposure testing, the exposed fibers are subjected to denier (dtex) and Instron (as described above) testing to measure resistance to these harsh conditions. The tenacity of the exposed fibers is compared to unexposed fibers taken from the same item.

EXAMPLES

This invention will now be illustrated by the following specific examples. All parts and percentages are by weight unless otherwise indicated. Examples prepared according to the process or processes of the current invention are indicated by numerical values. Control or Comparative Examples are indicated by letters.

Example 1

In this example of the invention, a staple fiber was produced having a spun fiber formic acid RV of 147.

Polymer flake was fed to a SPP vessel 16 of a SPP apparatus like the one illustrated in FIG. 1. The flake polymer was homopolymer nylon 6,6 (polyhexamethylene adipamide) containing a polyamidation catalyst (i.e., manganous hypophosphite obtained from Occidental Chemical Company with offices in Niagara Falls, N.Y.) in concentration by weight of 16 parts per million and a stabilizer (i.e., IRGANOX™ 1098, obtained from Ciba-Geigy with offices in Hawthorne, N.Y.) in 0.3% by weight concentration. The flake which was fed into the SPP vessel 16 had a formic acid RV of 48. A serially connected dual desiccant bed regenerative drying system 14 was connected in parallel with an adjustable solenoid activated valve 36 between the blower 30 and the dew point measurement instrument 120 of the gas system 12 as illustrated in FIGS. 2 and 3. The dryer 50 was a Sahara Dryer, model number SP-1800 commercially available from Henderson Engineering Company of Sandwich, Ill. The gas circulated through the gas system 12 was nitrogen. The regenerative dual desiccant bed circulating gas drying system 14 was used to increase the RV of the polymer flake. The pressure of the gas in the drying system 14 was about 5 psig (35 kilopascals). The dew point temperature of the gas exiting the dryer system 14 as measured by instrument 110 was less than 0° C. Higher RV flake was removed from a flake outlet 22 of the SPP vessel 16 which was then fed to a non vented twin screw melt-extruder 132, which melted and extruded the flake into molten polymer into a transfer line 132 which was pumped to a manifold 146 and metered to a plurality of spinnerets 151,152 and then spun into filaments 170 as illustrated in FIG. 4. The residence time of the polymer in the melt-extruder 132 and transfer line 136 was about 5 minutes. The filaments were converged into a continuous filament tow. A plurality of the continuous filament tows were converged into a continuous filament tow band and then drawn. The drawn band 170 was crimped and cut into staple fibers 202 with a spun fiber formic acid RV of 147. The staple fibers 202 produced were approximately 15 denier (16.7 decitex) per filament. Other process conditions used to reach this high molecular weight are shown in Table 1.

Here, the temperature of the dry gas at the gas inlet 24 to the SPP vessel 16 is on the high side of the preferred range. This higher conditioning temperature drives the polymer temperature also to the high side of its preferred range. Still a very suitable high RV fiber is produced. In this case, the gas drying system 14 was used to produce a uniform high RV fiber.

TABLE 1

| | Regenerative dryer off | | | | | Regenerative dryer on | | | |
|---|---|---|---|---|---|---|---|---|---|
| Example: | A | B | C | D | E | 1 | 2 | 3 | 4 |
| Condition/property | | | | | | | | | |
| Spun Fiber RV | 87 | 109 | 116 | 137 | 111 | 147 | 161 | 169 | 161 |
| Recirculating Gas Temperature at gas inlet | 185 | 189 | 189 | 193 | 188 | 180 | 155 | 175 | 175 |
| Within 5 feet (1.5 m) of Extruder Discharge Polymer Temp. | 291 | 291 | 290 | 296 | 291 | 297 | 296 | 291 | 291 |
| Polymer Temperature In transfer line | 292 | 292 | 291 | 297 | 292 | 298 | 297 | 292 | 291 |
| Within 5 feet (1.5 m) of Spinneret, Manifold Polymer Temperature | 296 | 296 | 295 | 302 | 296 | 303 | 302 | 296 | 296 |
| Polymer throughput (Lbs./Hr.)# | 1870 | 1870 | 1870 | 1660 | 1870 | 1660 | 1460 | 1460 | 1460 |
| Combined Gas Dew Point Temp. | 43* | 43* | 43* | 43* | 43 | 17* | 11* | 11* | 11 |
| % valve closure automatic valve in main gas line. | 0% | 0% | 0% | 0% | 0% | 60% | 71% | 73% | 71% |

TABLE 1-continued

| | Regenerative dryer off | | | | | Regenerative dryer on | | | |
|---|---|---|---|---|---|---|---|---|---|
| Example: | A | B | C | D | E | 1 | 2 | 3 | 4 |
| Flake RV fed to SPP Vessel | 48 | 48 | 48 | 48 | 47 | 48 | 49 | 47 | 47 |
| Polymer flake RV @ exit of SPP V | *** | 102** | 104** | 118 | 102 | *** | 98** | 99** | 99 |

All temperatures are in degrees Celsius;
Dew point temperatures in degrees Celsius.
RV numbers are formic acid RV's.
# one pound = 0.454 kilogram
*Calculated value based on model of SPP conditions and measured value, expected to be in the range of 35–45 degrees C. without the drying system and expected to be in the range of 10–20 degrees C. with the drying system
**Calculated from model of SPP conditions and measured value under similar conditions.
***Data is not available

Comparative Example A

This comparative example demonstrates the superior abrasion resistance and flex fatigue resistance of the Example 1 filaments of the present invention as compared to lower RV filaments substantially the same as those commercially used for making papermaking machine felts in the early 1990s.

The procedure of Example 1 was followed using the same equipment, except the drying system was not used. In other words, the adjustable valve 36 was fully open and the manual valves 38,54 were completely closed. Process conditions that varied from Example 1 are shown in Table 1. The staple fiber produced had a spun fiber formic acid RV of 87. This fiber is substantially the same as a standard product which was commercially sold by E. I. du Pont de Nemours and Company of Wilmington, Del., and used by purchasers for making papermaking machine felts, in the early 1990s.

Table 2 provides data on fiber abrasion and flex life for the 147 RV staple fibers produced in Example 1 of the invention as compared to 87 RV staple fibers produced in Comparative Example A. These data illustrate the importance of high RV fiber on resistance to wear as measured by fiber abrasion and flex resistance testing. The Example 1 (147 RV) fiber shows superior strength retention as measured by a significant increase in the cycles to failure in both tests.

TABLE 2

| | | | Flex Resistance Abrasion Resistance | |
|---|---|---|---|---|
| Example | RV | Denier* per filament | Avg. Cycles to Failure | Median Cycles to Failure |
| A | 87 | 14.4 | 471 | 61,794 |
| 1 | 147 | 14.8 | 617 | 87,791 |

*denier × (10/9) = decitex

Example 2

In this example of the invention, a staple fiber was produced having a spun fiber formic acid RV of 161.

The procedure of Example 1 was followed using the same equipment, except as follows. The gas inlet temperature was reduced 25° C. A greater fraction of the circulating gas was passed through the drying system. The molten polymer was at a lower temperature in the transfer line. Process conditions that varied from Example 1 are shown in Table 1. The staple fiber produced had a formic acid RV of 161 which is substantially greater than the 147 RV fiber produced in Example 1.

Comparative Example B

This comparative example demonstrates that high RV filaments of the invention provide superior chemical and thermal resistance as compared to lower RV filaments which are presently commercially sold and used in making papermaking machine felts.

The procedure of Comparative Example A was followed using the same equipment, except the gas inlet temperature was 1° C. higher. Process conditions are shown in Table 1. The staple fiber produced had a spun fiber formic acid RV of 109 which is much higher than the 87 RV fiber produced in Comparative Example A. This fiber is presently on sale by E. I. du Pont de Nemours and Company of Wilmington, Del., and used by purchasers for making papermaking machine felts.

Table 3 provides data on chemical and thermal resistance of Example 2 fibers with 161 RV compared with Comparative Examples A and B fibers made at lower RVs. These data support the importance of high RV fiber to provide resistance to oxidative media and high heat. The 161 RV fiber of Example 2 shows superior strength retention, over the fibers of Comparative Examples A and B, as measured by retained tenacity.

TABLE 3

| Ex | RV | Denier**/ fil | X | Y | Z | W |
|---|---|---|---|---|---|---|
| A | 87 | 14.4 | 5.30 | 39% (2.09) | 42% (2.25) | 5% (2.93) |
| B | 109 | 15.0 | 5.87 | 43% (2.54) | 48% (2.81) | 71% (4.18) |
| 2 | 161 | 14.7 | 5.60 | 61% (3.40) | 56% (3.16) | 84% (4.68) |

X = unexposed fiber tenacity in grams per denier
Y = 1000 ppm NaOCl exposure*; percent tenacity retained & (meas. grams per denier)
Z = 3% $H_2O_2$ exposure*; percent tenacity retained & (meas. grams per denier)
W = 130 degree celsius; percent tenacity retained & (meas. grams per denier)
*for 72 hours @ 80 degree C.
**denier × 10/9 = decitex

Examples 3 and 4

These examples of the invention vary the dew point temperature of the drying gas and, thus, demonstrate the impact of the low dew point temperature of the drying gas on the RV of the produced fiber and on the polymer temperature in the transfer line before spinning. Specifically they show that higher RV filaments can be produced, than those produced in Example 1, using a combination of circulating gas temperatures, dew point temperatures and polymer temperatures throughout the transfer line that are lower than those used in Example 1.

The procedure of Example 1 was followed using the same equipment, except process conditions that varied from Example 1 are shown in Table 1. The staple fiber produced in Example 3 had a spun fiber formic acid RV of 169 and the staple fiber produced in Example 4 had a spun fiber formic acid RV of 161.

Comparative Examples C, D and E

Examples C and E produced filaments which are essentially the same as filaments presently sold for use in making papermaking machine felts under typical processing conditions without a drying system, but the spun filaments have a spun fiber formic acid RV substantially less than that of the present invention. example D was an attempt to increase the RV of the spun filaments as much as possible utilizing the same apparatus as Example C, but still not using a drying system. Although Example D shows an increase in spun fiber RV, the Example D fibers had a spun fiber RV lower than those of the present invention with an associated undesired increase in polymer temperature throughout the transfer line. This increase in temperature throughout the transfer line increases the degradation of the polymer prior to spinning.

The procedure of Comparative Example A was followed using the same equipment, except process conditions that varied from Comparative Example A are shown in Table 1. The staple fiber produced in Comparative Example C had a spun fiber formic acid RV of 116; the staple fiber produced in Comparative Example D had a spun fiber formic acid RV of 137; and the staple fiber produced in Comparative Example E had a spun fiber formic acid RV of 111.

In Table 4, Comparative Examples C, D, and E process and product parameters are compared to process and product parameters of invention Examples 3 and 4. Examples 3 and 4 show that an increase in fiber RV (molecular weight) to above 160, and as high as 169, is possible while using a drying gas temperature 13 to 18 degrees Celsius lower than for Comparative Examples C, D, and E. The increase in fiber RV (molecular weight) in Examples 3 and 4 is beyond the level possible without the regenerative drying system as shown by Comparative Examples C, D, and E. High RV is achieved primarily by increasing the temperature of the drying gas in the solid phase polymerization vessel. As the drying gas temperature is increased the polymer transfer line temperature increases also. This temperature increase in polymer temperature in the transfer line limits the level of RV achievable, so that further increases in the drying gas temperature do not result in higher fiber RV. In general, polyamide polymerization reactions are limited by the amount of moisture in the melt, as well as, thermal degradation. These examples show that polymer temperatures in excess of 305° C. result in significant losses in fiber RV (molecular weight), occurring mostly in the polymer transfer line. These high polymer temperatures reduce the stability of the process resulting in increased variability of the fiber RVs.

Significant and most surprising is that the low drying temperature allows the melt process to operate without significant increases in polymer temperatures in the transfer line. The increased polymerization in the SPP vessel, along with the ability to maintain the polymer temperature lower at 292 degrees Celsius provides the ability to produce fibers with the very high molecular weight. In general, the high RV (high molecular weight) polymer is harder to pump and demands some alteration to the polymer throughput to maintain filament denier on aim.

TABLE 4

| Ex | I | II | III | IV | V | VI |
|---|---|---|---|---|---|---|
| C | 48 | 189 | 0 | 291 | 116 | 1870 |
| D | 48 | 193 | 0 | 297 | 137 | 1870 |
| E | 47 | 188 | 0 | 292 | 111 | 1870 |
| 3 | 47 | 175 | 73 | 292 | 169 | 1460 |
| 4 | 47 | 175 | 71 | 291 | 161 | 1460 |

I = formic acid method relative viscosity (RV) of flake
II = gas inlet temperature to SPP vessel degrees Celsius
III = percent of automatic valve closure for side stream flow to regenerative drying system
IV = polymer temperature in transfer line degrees Celsius
V = formic acid RV of spun fiber
VI = throughput of booster pump to polymer transfer line in pounds per hour (1 pound = 0.454 kilogram)

Furthermore, fiber tenacity and tenacity uniformity is shown to not be negatively affected by an increase in RV (molecular weight) to at least about 140. This fact is demonstrated by comparing the variability of the tenacity for Example 3 versus Comparative Example C. As shown in Table 5, the tenacity variability as measured by standard deviation and coefficient of variation for both items is similar.

TABLE 5

| Example | Fiber RV | Average Tenacity | Std. Deg. Tenacity | Coefficient Variation |
|---|---|---|---|---|
| C | 116 | 5.18 | 0.54 | 10.4% |
| 3 | 169 | 5.35 | 0.42 | 7.9% |

In each case, 50 filaments were measured. Tenacity is reported in grams per denier.

What is claimed is:

1. A process for melt phase polymerization of polymer for making filaments for use in making staple fibers for papermaking machine felts, comprising:

feeding polymer flake at a temperature of about 120° C. to about 180° C. into a non vented melt-extruder, the flake comprising:

a synthetic melt spinnable polyamide polymer, a formic acid relative viscosity of about 90 to about 120, and a polyamidation catalyst dispersed within the flake;

melting the flake in the melt-extruder and extruding molten polymer from an outlet of the melt-extruder to a transfer line wherein the temperature of the molten polymer in the transfer line within about 5 feet (2.4 m) of the outlet of the melt-extruder is about 290° C. to about 300° C.;

conveying the molten polymer through the transfer line to at least a spinneret of at least a spinning machine such that the temperature in the transfer line within 5 feet (2.4 m) of the at least a spinneret is about 292° C. to about 305° C., with a residence time in the melt-extruder and the transfer line of about 3 to about 15 minutes; and spinning the molten polymer through the at least a spinneret forming a plurality of the filaments having a formic acid relative viscosity of at least about 140.

2. The process of claim 1, further comprising:

utilizing a twin screw melt-extruder as the melt-extruder.

3. The process of claim 1, further comprising:

spinning the molten polymer through a plurality of the spinnerets, each of the spinnerets forming a plurality of the filaments; and converging the filaments into at least a continuous filament tow.

4. The process of claim 3, further comprising:

combining a plurality of the at least a continuous filament tow into a tow band;

drawing the tow band;

crimping the tow band; and cutting the tow band into the staple fibers.

* * * * *